United States Patent [19]

Poling

[11] Patent Number: 4,862,776

[45] Date of Patent: Sep. 5, 1989

[54] DRAIN PLUG REMOVING DEVICE

[76] Inventor: Denzil C. Poling, Rte. 6, Box 80, Hagerstown, Md. 21740

[21] Appl. No.: 109,169

[22] Filed: Oct. 16, 1987

Related U.S. Application Data

[63] Continuation-in-part of Ser. No. 29,537, Mar. 24, 1987, Pat. No. 4,794,827.

[51] Int. Cl.[4] ..... B25B 13/02

[52] U.S. Cl. ..... 81/125; 81/177.6; 294/19.1

[58] Field of Search ..... 81/125, 64, 177.6; 294/99.2, 79.1, 22

[56] References Cited

U.S. PATENT DOCUMENTS

| | | | |
|---|---|---|---|
| 70,586 | 11/1867 | Mansur . | |
| 519,354 | 5/1894 | Sheppard | 294/19.1 |
| 1,188,305 | 6/1916 | Noerteman . | |
| 1,668,245 | 5/1928 | McGowan . | |
| 1,686,749 | 10/1928 | Higgins et al. . | |
| 2,498,324 | 2/1950 | Yourglich et al. | 81/3 |
| 2,746,330 | 5/1956 | Pfetzing | 81/53 |
| 3,039,159 | 6/1962 | Burke | 24/81 |
| 3,192,585 | 7/1965 | Montag | 24/137 |
| 3,756,096 | 9/1973 | Bolden | 294/19.1 |
| 3,967,697 | 7/1976 | Guenther | 184/1.5 |
| 4,098,398 | 7/1978 | Meyers | 206/223 |
| 4,101,000 | 7/1978 | Scully | 184/1.5 |
| 4,145,939 | 3/1979 | Garrison | 81/125 |
| 4,177,529 | 12/1979 | Sikula, Jr. | 7/100 |
| 4,219,062 | 8/1980 | Berkman | 145/52 |
| 4,230,002 | 10/1980 | Skidmore | 81/121 |
| 4,274,645 | 6/1981 | Ferguson | 280/47.26 |
| 4,283,032 | 8/1981 | Smith | 248/97 |
| 4,592,448 | 6/1986 | Morris | 184/1.5 |

*Primary Examiner*—Frederick R. Schmidt
*Assistant Examiner*—Lawrence Cruz
*Attorney, Agent, or Firm*—Bernard, Rothwell & Brown

[57] ABSTRACT

A drain plug removing device includes a clip for rotatably engaging and selectively holding a head of a threaded drain plug. The clip has an axis of rotation and includes a pair of openable jaws urged together by a spring. The device includes a selectively bendable, flexible shaft attached to the clip at one end thereof, the shaft being formed of a reboundable coil spring extending away from the clip along the axis of rotation of the clip when the shaft is in an unflexed configuration. The shaft has a handle at another end thereof opposite the clip, such that rotation of the handle applies rotational force to the shaft, which in turn applies rotational force to the clip to cause rotation of the clip and a drain plug held therein. A drain plug can be removed from a crankcase oil pan with the device of the invention without spilling oil onto the fingers and without dropping the plug into a drainage catch basin or funnel beneath the oil pan.

2 Claims, 2 Drawing Sheets

DRAIN PLUG REMOVING DEVICE

CROSS REFERENCE TO RELATED APPLICATION

The present application is a continuation-in-part of co-pending U.S. Ser. No. 029,537, filed Mar. 24, 1987.

BACKGROUND OF THE INVENTION

1. Field of the Invention

The present invention relates to the extraction of threaded drain plugs and the like from containers such as automotive crankcase pans for replacement of oil or other liquids present therein.

2. Description of the Background Art

Removing plugs used to retain oil in automotive-type crankcases and the like has remained essential by the same since the debut of tee internal combustion engine. Typically, a catch basin or drainage funnel is placed below the drain plug and the drain plug is loosened with a tool. The drain plug then is usually removed by rotating the plug with the fingers. The oil often spills onto the fingers upon removal of the drain plug, and may cause burns if it is hot. Often, the drain plug is dropped into the catch basin or drainage, requiring further contact with the dirty oil to locate the dropped plug.

U.S. Pat. No. 4,145,939 to Garrison discloses a drain plug holder having a socket attached to a short spindle and chain. The socket has a magnet therein for holding a plug, and the chain has a magnet at one end thereof securing the chain and plug holder to a metal member beneath a car. A drain plug is removed by rotating the spindle, and if the plug drops, it may be held by the magnet. However, the location of the spindle does not ensure that hot oil will not gush onto the fingers, and if the plug drops with sufficient momentum, the magnetic force can break and allow the plug to fall into the oil drainage basin.

There are numerous other oil change devices proposed in the prior art, including expired U.S. Pat. No. 1,668,245 to McGowan disclosing a rotating crankcase drain funnel having a drain hose and a socket for removing the drain plug.

Expired U.S. Pat. No. 1,686,749 to Higgins et al. discloses an oil catch basin with a geared drain plug-removing wrench mounted thereon.

Expired U.S. Pat. No. 2,746,330 to Pfetzing discloses a unitary wrench and container for removing an oil filter including an oil-catching cup, a rotatable socket and a handle for rotating the socket.

U.S. Pat. No. 3,967,697 to Guenther discloses a crankcase oil drainage and collection device that requires a special drain plug having a passageway therein such that on partial removal of the plug, oil can drain from the crankcase into a funnel that directs the oil into an oil container.

U.S. Pat. No. 4,230,002 to Skidmore discloses a device for removing a plug and draining oil from a vehicle oil pan including a socket for removing the drain plug, a funnel for catching draining oil and an oil drain hose.

U.S. Pat. No. 4,592,448 to Morris discloses an oil pan drain receptacle including an oil-catching conduit for attachment to a crankcase by means of Velcro fasteners, a drain plug-removing wrench that is rotatable within the conduit, and a bag for collecting draining oil passing through the conduit.

Other devices for assisting replacement of motor oil in engines are disclosed in U.S. Pat. Nos. 4,098,398; 4,101,000 and 4,283,032. None of the above-described devices have enjoyed any significant degree of commercial success, primarily because of the time and expense in making use of them. All of the known devices have drawbacks, some requiring alteration of the plug to be removed or of the crankcase pan, others necessitating hand holding of a funnel while draining the oil.

Clip devices unrelated to oil plug removal are also known. U.S. Pat. No. 4,219,062 to Berkman discloses a magnetic fastener-holding tool attachment having a spring fingered device used to hold a screw.

Expired U.S. Pat. No. 3,039,159 to Burke discloses a clip for attaching to a high chair, the clip being connected by a string to a block for securing a spoon or the like in a loop.

Expired U.S. Pat. No. 3,192,585 to Montag discloses a combined hanger clip and clothes pin.

There remains a need in the art for a simple easy-to-use device to remove the plug from a crankcase pan while avoiding spillage onto the fingers and preventing the plug from falling into the drainage.

SUMMARY OF THE INVENTION

In accordance with the present invention, a drain plug removing device includes a clip for rotatably engaging and selectively holding a head of a threaded drain plug. The clip has an axis of rotation and includes a pair of openable jaws with a spring urging the jaws together. The drain plug removing device includes a selectively bendable, flexible shaft attached to the clip at one end thereof, the shaft being comprised of a reboundable coil spring extending away from the clip along the axis of rotation of the clip when the shaft is in an unflexed configuration. The shaft has a handle at another end thereof opposite the clip, wherein rotation of the handle applies rotational force to the shaft, which in turn applies rotational force to the clip to cause rotation of the clip and a drain plug held therein.

DETAILED DESCRIPTION OF THE PREFERRED EMBODIMENT

Figure 2:
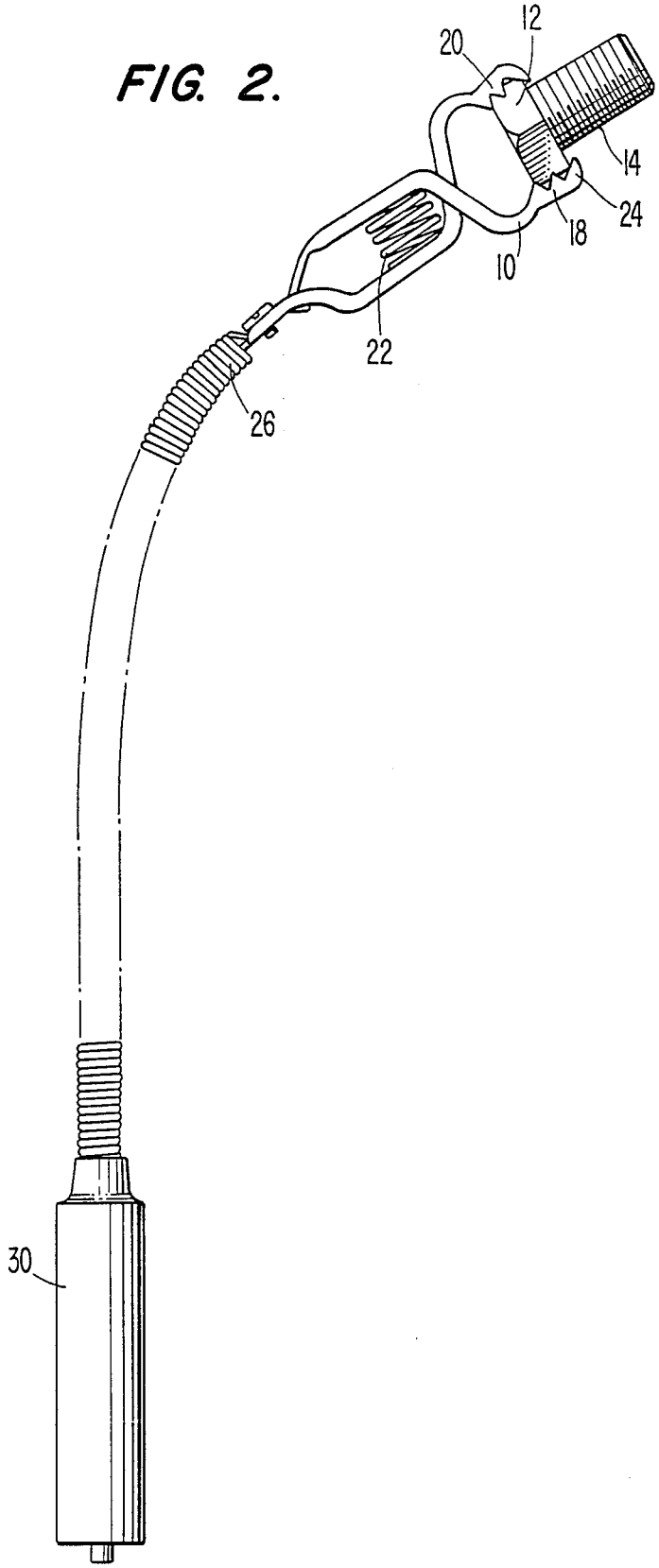
FIG. 2 is an elevation view of the drain plug removing device shown in FIG. 1 engaged with the head of a drain plug and with the reboundable shaft in a bent configuration for removal of a drain plug without spillage of oil onto the fingers.

With reference to the drawings, a drain plug removing device according to the present invention includes a clip 10 for rotatably engaging and selectively holding a head 12 of a threaded drain plug 14 shown in FIGS. 2. Drain plug 14 permits drainage and replacement of oil from an automotive crankcase oil pan (not shown) or the like.

Prior to engagement to the clip 10 with the head 12 of a drain plug 14, the drain plug is loosened utilizing a socket wrench or other suitable tool.

The clip 10 has an axis of rotation 16, and a pair of openable jaws 18 and 20 that are urged towards each other by a spring 22. Jaws 18 and 20 include plug head-gripping teeth 24 that grip the sides of the head 12 of bolt 14, as well as grip underneath the head 12 of bolt 14 after the bolt has been slightly loosened using a conventional wrench.

A selectively bendable, flexible shaft 26 is attached to clip 10 at one end thereof, the shaft being comprised of a reboundable coil spring extending away from the clip along the axis of rotation of the clip when the shafts in an unflexed configuration. Shaft 26 is attached to clip 10 by any suitable means, such as by screw 28.

A handle 30 is attached to the spring shaft 26 at an end of the shaft opposite clip 10, such that rotation of the handle applies rotational force to the shaft, which in turn applies rotational force to the clip to cause the clip 10 and a drain plug 14 held therein to rotate.

Figure 1:
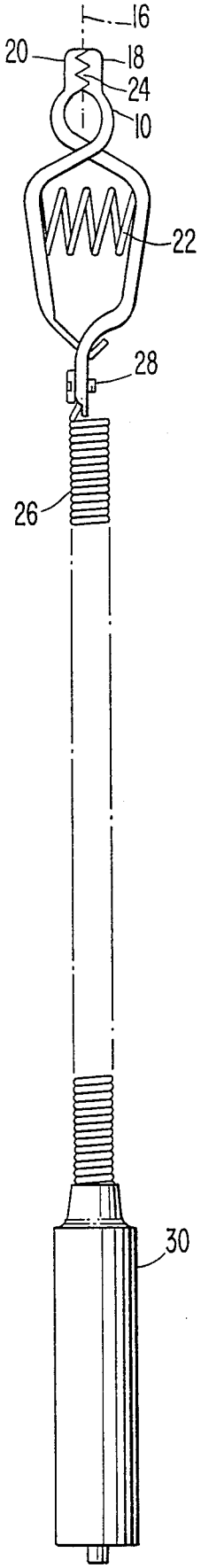
FIG. 1 is an elevation view of a drain plug removing device according to the present invention.

When the shaft 26 is in an unflexed configuration as shown in FIG. 1, both the coil spring shaft 26 and the handle 30 are in line with the axis of rotation of the clip. For removal of a drain plug, a conventional wrench (not shown) is used to loosen plug 14 before clip 10 is engaged with the head 12 of plug 14. Clip 10 is then rotated by rotation of the handle 30, during which shaft 26 can be bent, e.g., into the configuration shown in FIG. 3. When drain plug 14 exits the drainage opening in the oil pan, shaft 26 rebounds from the bent configuration shown in FIG. 2 to the straight configuration shown in FIG. 1. Contact between the fingers of the user and both plug 14 and oil escaping from the oil pan is avoided, and the plug is prevented from falling into the oil drainage means. The present invention thus provides a simple and easy-to-utilize device for removing a plug from a crankcase pan while eliminating spillage onto the fingers and preventing the plug from falling into drainage such as a catch basin or funnel beneath the pan.

Since many modifications, variations and changes in detail can be made to the described embodiment, it is intended that all matter in the foregoing description and shown in the accompanying drawings be interpreted as illustrative and not in a limiting sense.

What is claimed is:

1. A drain plug removing device comprising a clip for rotatably engaging and selectively holding a head of a threaded drain plug, the clip having an axis of rotation and including a pair of openable jaws for complementarily engaging said head, each jaw having a separate jaw arm associated therewith with a separate spring means between the jaw arms for urging the jaws together so as to engage and selectively hold said head of the threaded drain plug, the jaw arms being engageable by a user's fingers to bias the jaw arms toward each other and hereby spread the jaws apart for engagement and disengagement with said head, said jaws including means for extending underneath the head of at least a partially loosened drain plug to grip said head and prevent said head from disengaging with said jaws when the jaws are urged together, the device including a selectively bendable, flexible shaft attached to the clip at one end thereof, the shaft being comprised of a reboundable coil spring extending away from the clip along the axis of rotation of the clip when the shaft is in an unflexed configuration, the shaft having a handle at another end thereof opposite the clip, wherein rotation of the handle applies rotational force to the shaft, which in turn applies rotational force to the clip to cause rotation of the clip and a drain plug held therein.

2. The device of claim 1 wherein the handle is in line with the axis of rotation of the clip when the shaft is in an unflexed configuration.

* * * * *